United States Patent [19]

Bernstein et al.

[11] Patent Number: 5,010,606

[45] Date of Patent: Apr. 30, 1991

[54] BATH SEAT

[75] Inventors: Michael S. Bernstein, Natick, Mass.; David W. Crossley, Woonsocket, R.I.; Michael I. Lerner, Brookline, Mass.

[73] Assignee: Safety 1st, Inc., Chestnut Hill, Mass.

[21] Appl. No.: 485,619

[22] Filed: Feb. 27, 1990

[51] Int. Cl.[5] ..... A47K 3/024

[52] U.S. Cl. ..... 4/572; 4/579; 272/146; 297/467

[58] Field of Search ..... 4/560, 562, 563, 571, 4/572, 578, 579; 272/70.3, 70.4, 146; 297/467

[56] References Cited

U.S. PATENT DOCUMENTS

| | | | |
|---|---|---|---|
| D. 188,838 | 9/1960 | Johnson | 4/572 X |
| D. 284,690 | 7/1986 | Mandelbaum | D23/69 |
| D. 288,118 | 2/1987 | Boucher | D23/69 |
| 2,645,781 | 7/1953 | Mover | 4/572 |
| 2,697,478 | 12/1954 | McKinney | 272/70.4 |
| 3,022,518 | 2/1962 | Hayden | 4/562 |
| 3,086,222 | 4/1963 | Hall et al. | 4/579 X |
| 3,100,639 | 8/1963 | Bonewitz | 272/146 |
| 3,203,008 | 8/1965 | Murcott | 4/578 X |
| 3,422,466 | 1/1969 | Banoczi | 4/579 X |
| 3,504,927 | 4/1970 | Seki | 272/70.3 X |
| 3,619,823 | 11/1971 | Sackett | 4/579 X |
| 3,718,365 | 2/1973 | Gibson | 4/579 X |
| 3,995,331 | 12/1976 | Fotre et al. | 4/579 X |
| 4,650,246 | 3/1987 | Henriksson | 297/467 X |

FOREIGN PATENT DOCUMENTS

| | | | |
|---|---|---|---|
| 288047 | 10/1988 | European Pat. Off. | 4/572 |

*Primary Examiner*—Henry J. Recla
*Assistant Examiner*—Robert M. Fetsuga
*Attorney, Agent, or Firm*—Wolf, Greenfield & Sacks

[57] ABSTRACT

A generally circular bath seat providing back support and positionable rotationally in a bath tub with means for selectively securing the relative seat position.

23 Claims, 3 Drawing Sheets

BATH SEAT

FIELD OF THE INVENTION

This invention relates in general to bath seats and is more particularly concerned with a bath seat for infants.

BACKGROUND OF THE INVENTION

Many devices have been proposed to be used for supporting children in a bathtub in connection with their bathing. In particular, such devices have consisted simply of a bath ring which has suction cups enabling it to be mounted securely within, and to be readily removable from a bath tub. Such devices are shown for example in U.S. design Pat. No. 284,690 issued July 15, 1986 to Mandelbaum, and U.S. design Pat. No. 288,118 issued Feb. 3, 1987 to Boucher. Although devices of a simple ring structure are adequate for aiding children who are able to sit up unaided, bath seats have been proposed which enable securing the child so that the hands of the person bathing the child are both free while the child is held securely. Such a device is shown for example in U.S. Pat. No. 2,645,781, issued July 21, 1953 to Mover. In that device a backrest having suction cups is proposed which includes a harness to be affixed to the infant and to restrain it from sliding into the water, while supporting the child's head. Finally, bathing chairs have been proposed with adjustable backrests such as shown in U.S. Pat. 3,086,222 issued Apr. 23, 1963 to Hall. In the latter device a slidable backrest is proposed which can be affixed in several extended positions.

None of the prior art devices propose a simple circular bath seat which not only provides back support but also is positionable rotationally in a bath tub where the person bathing the child is enabled to reposition the child and secure the relative position of the seat in order to more easily bathe the child.

It is therefore one object of the invention to provide a bath seat for children in which a substantially rigid back support is provided while allowing for repositioning of the seat with respect to its base.

A further object of the invention is to provide a positionable bath seat for infants within a bath tub which enables the repositioning of the infant while sitting within the device in different relative positions with respect to the tub for ease in bathing.

A still further object of the invention is to provide a positionable baby bath seat wherein the relative rotational position of the seat with respect to the bath tub surface is adjustable and retainable in the adjusted position.

DESCRIPTION OF THE DRAWINGS

The foregoing and other objects of the invention will become more readily apparent from a reading of the description following hereinafter, and an examination of the drawings in which.

DESCRIPTION OF THE INVENTION

Figure 1:
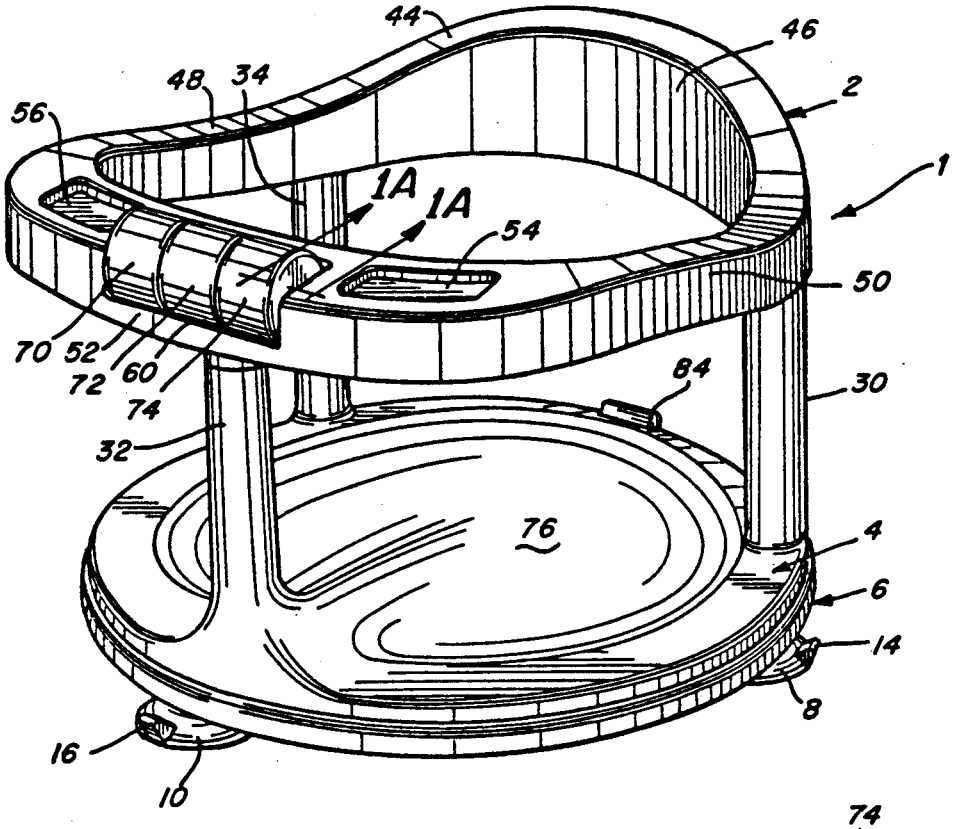
FIG. 1 is a perspective view of the bath seat of the invention.
Figure 1A:
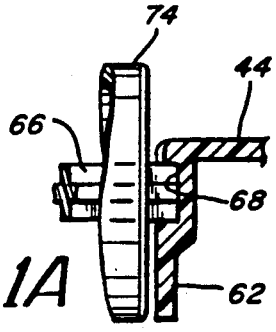
FIG. 1A is an enlarged partial cross-sectional view of the front section of the top portion of the bath seat taken along line 1A—1A of FIG. 1.
Figure 2:
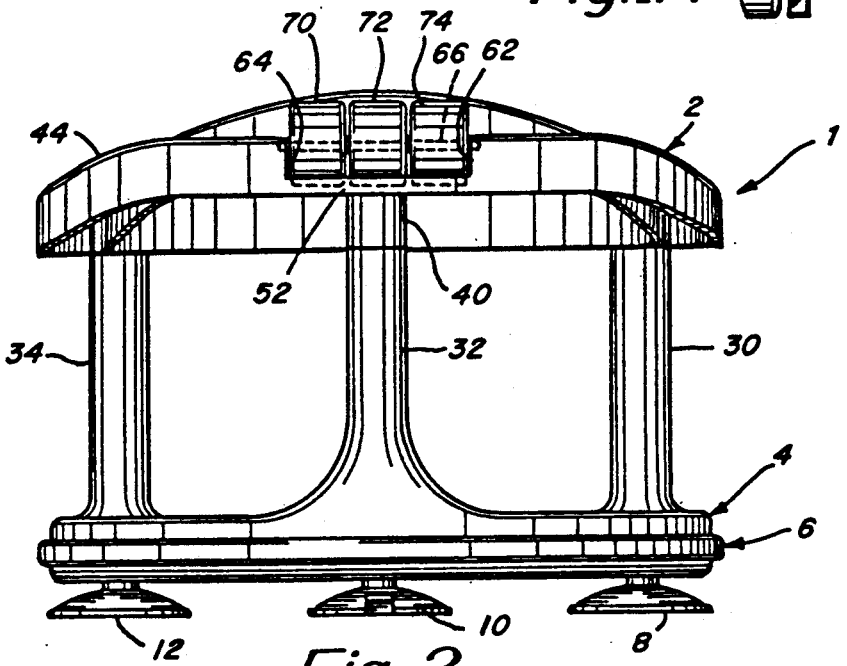
FIG. 2 is a front elevational view of the bath seat of FIG. 1.
Figure 3:
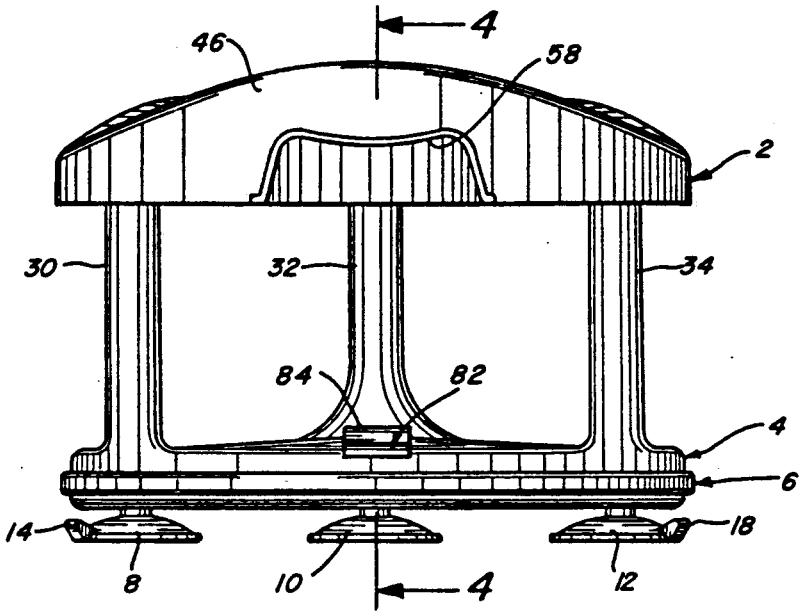
FIG. 3 is a rear elevational view of the bath seat of FIG. 1.
Figure 4:
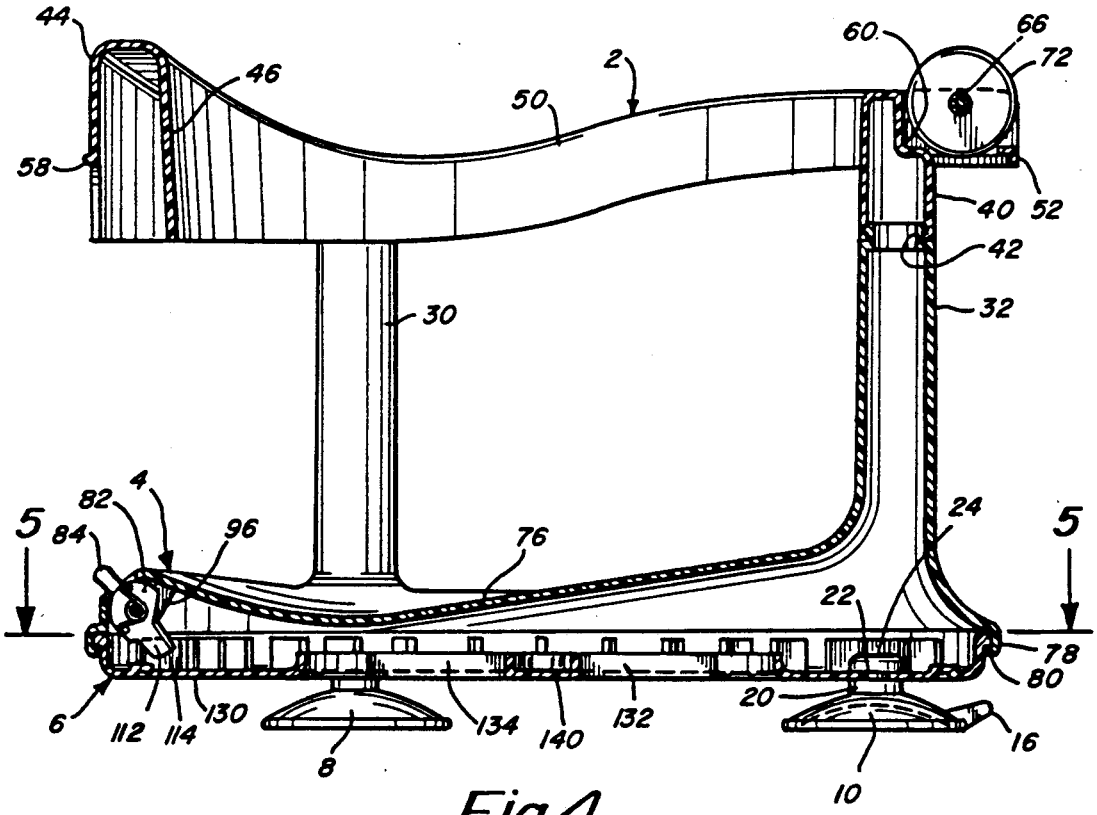
FIG. 4 is a cross-sectional view taken along line 4—4 of FIG. 3.
Figure 5:
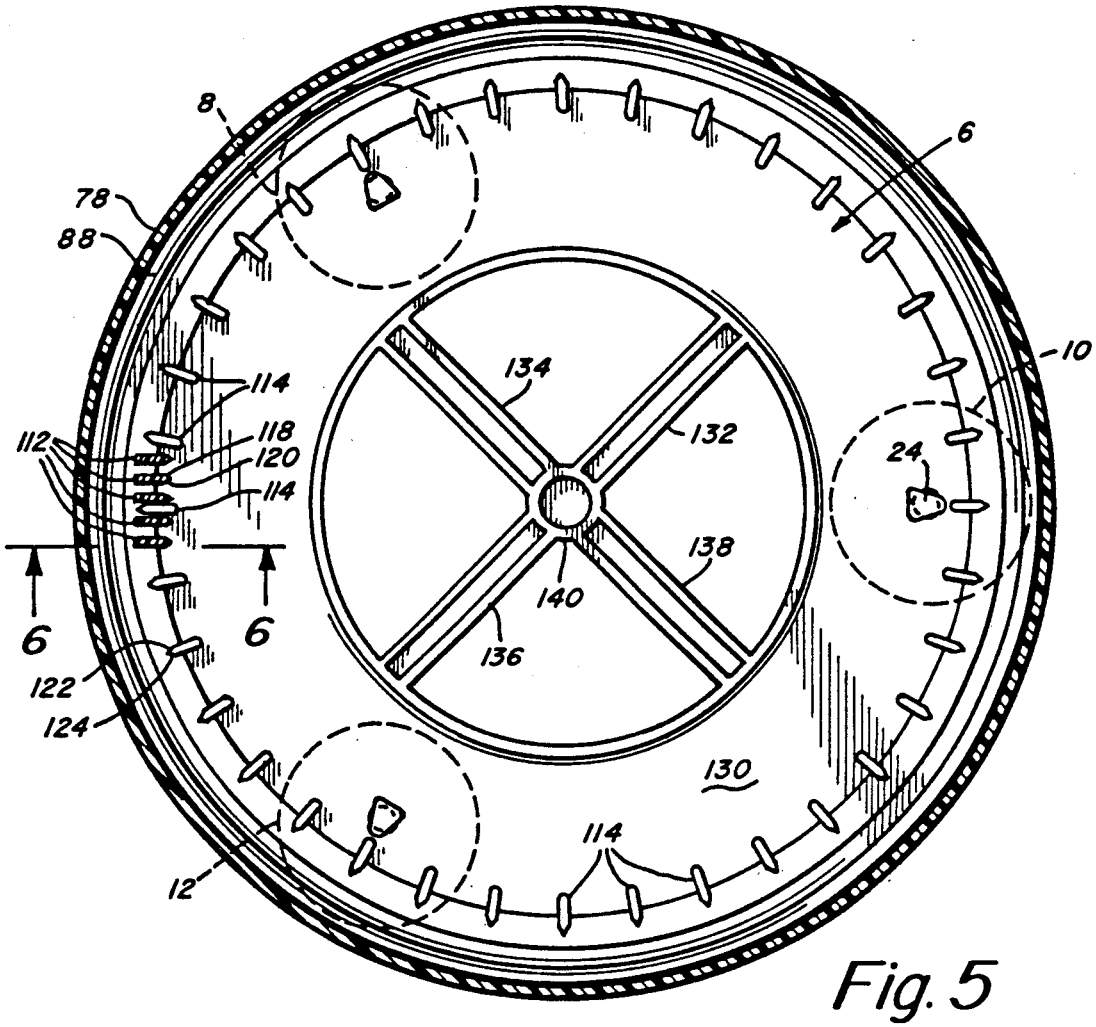
FIG. 5 is a cross-sectional view taken along line 5—5 of FIG. 4.

As seen in FIGS. 1 through 3, the bath seat of the invention 1 comprises three portions, a top portion 2 of generally circular configuration, an intermediate portion 4 and a complementary base portion 6, both being of circular configuration. All three elements may be made of molded plastic. The circular base portion 6 is held in an immobile position relative to a bath tub by means of the suction cups 8, 10 and 12. These suction cups are provided with respective release tabs 14, 16 and 18 in order to release the suction when it is desired to remove the bath seat from the bath tub. Each suction cup is formed in the same manner and therefore only one of such suction cups will be described in more detail. As seen in FIG. 4, suction cup 10 comprises a concave suction cup element of resilient material which has a central hub 20, a reduced diameter portion 22 and a retention head 24. As shown in FIG. 5, for example, the retention head 24 upon assembly will be positioned above the base member base plate 130, after passing through an opening in that base plate wherein the reduced diameter portion 22 will be accommodated.

The intermediate portion 4 is provided with a series of support posts 30, 32 and 34 to position the top portion at a distance from the contoured seat 76 to accommodate the infant. The support posts may be of the same length. The top portion is configured so that there is a backrest or back support 46, sidearm supports 48 and 50, and a front section 52 which is somewhat elevated. The front post 32 will not quite reach the U-shaped frame 44 and therefore will have a reduced section 42 enabling snap fit assembly to a female receptacle 40. The other posts 30 and 34 are assembled to the top portion 2 into receptacles (not shown), similar in nature to 40 but within the U-shaped channel 44, and not extending therebelow.

The front section 52 is provided with a pair of tray recesses 54 and 56 molded therein, and the rear section or back support 46 is provided with a carrying handle 58 which also is formed in a mold.

The front section is provided with a center opening 60 to accommodate a toy element. The opening 60 is provided by sidewalls 62 and 64. These sidewalls accommodate a cross-shaped axle 66, and as shown in FIG. IA this axle snap fits into a recess 68 in sidewall 62 and a similar opening in sidewall 64. Mounted on the axle 66 are one or more roller beads 70, 72 and 74 which can be multicolored and are free to rotate.

The intermediate body portion 4 is provided with a contoured seat 76 and a U-shaped rim 78 which is in turn provided with a lower lip 80. This rim 78 mates with a lip 88 on the base member 6 by having its lip 80 snap fit over lip 88 as more clearly shown in FIG. 6 to provide the relative rotational capability between base member 6 and intermediate member 4, and to retain member 4 to base 6.

Figure 6:
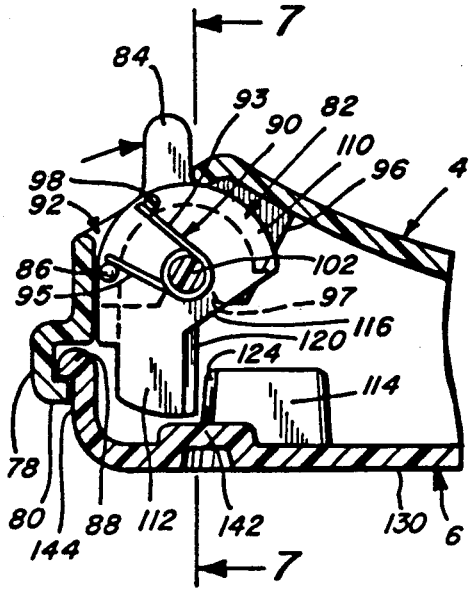
FIG. 6 is a cross-sectional view taken along line 6—6 of FIG. 5, but with the operating knob in the released position.

A detent mechanism is provided which enables retaining the intermediate member 4 in a desired rotational position with respect to base 6 and has the ability when desired to permit relative rotational motion therebetween. This detention means comprises a knob 82 which has a protruding operating lever 84. If desired, the relative dimensions of the parts can be such that they fit very snugly and the knob 82 can be positioned by the lever 84 and retained in any position between the limits of the opening 92 in the seat body 4 because of the snug fit. In this manner, the depending teeth 112 of the knob 86 can be positioned to either be vertically extending as shown in FIG. 6 or at an angle to the vertical as shown in FIG. 4.

Figure 7:
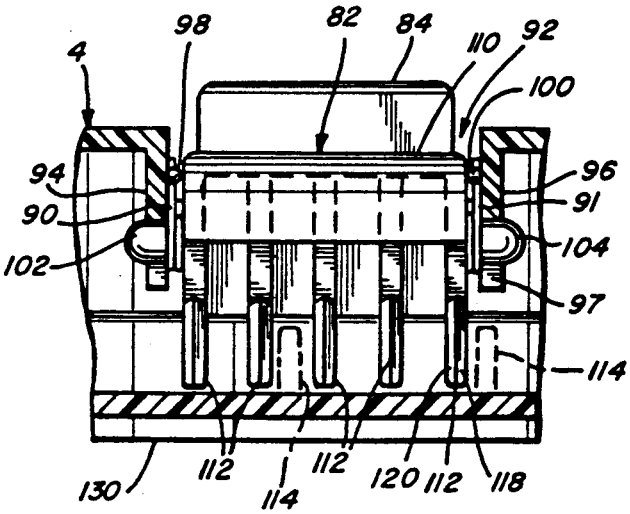
FIG. 7 is a cross-sectional view taken along line 7—7 of FIG. 6.

The knob is provided with stub shafts 102 and 104 which are snap fit into assembled position into the recesses such as 97 in the side depending walls 94, 96 of the intermediate member 4. Alternatively, torsion springs may be provided for the knob 82 so as to provide bias to urge it into a desired "normal" position. These springs 90, 91 are positioned one at each end of the knob 82. As more clearly shown in FIGS. 6 and 7, the torsion springs have legs 93 and 95 which are retained between a post 98 or 100 on the side walls 94, 96, respectively and a pin on the knob such as pin 86 shown in FIG. 6. A similar pin would be provided for the opposite side of the knob 82. FIG. 6 shows the knob 82 in the released position as indicated by the force arrow acting on operating lever 84. Again, the spring/pin arrangement can be such to operate either to provide a normal positioning of the depending teeth 112 so that they are in engagement with a series of upstanding lugs 114 on base 6, or normally in disengagement therewith. The arrangement shown in FIGS. 6 & 7 provides that the normal position of the depending teeth 112 on the body 110, which is generally of cylindrical nature, would be as shown in FIG. 4. In this figure, the lever 84 is in its lowermost position against one extremity of the opening 94, and the teeth 112 are in engagement with one or more upstanding walls or lugs 114 in the base 6. As shown in FIG. 7, a plurality of teeth 112 depend from the cylindrical body 10 (five being shown). These teeth have a tapered forward surface such as provided by the tapered surfaces 118, 120 (see FIG. 7). The cylindrical body 110 is cut away at 116 and is formed into the series of teeth 112 and to provide a recess so that when the teeth 112 are vertically positioned they will not interfere with the lugs 114.

The lugs 114 similarly have tapered surfaces 122 and 124 to allow for slight misalignment of the parts when positioning the teeth 112 into mating position with the lugs 114.

The base plate 130 of the base portion 6 is formed with a hollowed center which has a central hub 140 and structural reinforcement ribs 132, 134, 136 and 138. In order to provide a degree of rigidity to the rotational construction of the intermediate body 4 and base 6, a raised boss or rib 142 is provided in the base plate 130 adjacent the edge 144 of base plate 130.

What has been shown and described is a bath seat in a preferred embodiment. It will be readily understood by those skilled in the art that various modifications and rearrangements of parts may be accomplished without departing from the spirit and scope of the invention.

What we claim:

1. A bath seat comprising a base, intermediate and top portions, said intermediate portion being substantially planar and disposed proximate and superimposed over said base, said top portion including a generally circular enclosed frame having backrest, side arm and front sections, cooperating means between said base portion and intermediate portion to secure said intermediate and said base portions together and enabling rotational motion therebetween, a seat integrally formed in said intermediate portion and substantially in the plane with said cooperating means, and support means for supporting said top portion in a spaced-apart relationship with said intermediate portion, said support means including apertures that allow legs of a person using the seat to extend outwardly beyond an outer edge of the intermediate portion.

2. The bath seat of claim 1 including detention means adjustable into several positions wherein said relative motion is inhibited in one position and permitted in another position.

3. The bath seat of claim 2 wherein said adjustable detention means comprises a plurality of abutment surfaces on one of said base or intermediate portions and a movable detent on the other of said base or intermediate portions arranged to selectively engage at least one of the abutment surfaces.

4. The bath seat of claim 3 including spring means arranged to normally urge the detent into position where it is engaged with an abutment surface.

5. The bath seat of claim 3 wherein the abutment surfaces comprise a plurality of discrete wall elements on one of said base or intermediate portions extending toward the other one of said base or intermediate portions, and the said portion not having the wall elements being provided with a movable detent positionable to engage at least one of said wall elements to prevent said relative motion.

6. The bath seat of claim 5 wherein the movable detent is provided with a series of teeth which are positionable to engage one or more wall elements.

7. The bath seat of claim 6 wherein said detent is provided with an operating lever.

8. The bath seat of claim 5 including spring means arranged to normally urge the detent into position where it is engaged with an abutment surface.

9. The bath seat of claim 2 wherein said adjustable detention means comprises a plurality of abutment surfaces on either one of said base and intermediate portions and a movable detent on the other of said base or intermediate portions arranged to selectively engage at least one of the abutment surfaces.

10. The bath seat of claim 9 wherein the abutment surfaces comprise a plurality of discrete wall elements on one of said base or intermediate portions extending towards the other one of said base or intermediate portions, and the said portion not having the wall elements being provided with a movable detent positionable to engage at least one of said wall elements to prevent said relative motion.

11. The bath seat of claim 10 wherein the movable detent is provided with a series of teeth which are positionable to engage one or more wall elements.

12. The bath seat of claim 11 wherein said detent is provided with an operating lever.

13. The bath seat of claim 10 wherein said base portion is provided with a suction cup means enabling the affixing of said base to a surface in immobile position with respect thereto.

14. The bath seat of claim 1 wherein the front section is provided with a tray surface.

15. The bath seat of claim 1 wherein the front section is provided with a toy, said toy being captured by said front section to be normally inseparable therefrom.

16. The bath seat of claim 15 wherein said toy comprises at least one bead rotatably mounted on the front section of the top portion.

17. The bath seat of claim 1 wherein the support means includes a plurality of support posts.

18. The bath seat of claim 1 wherein the intermediate and base portions are generally of circular configuration as viewed in plan view, and the cooperating means comprises a pair of inter-engaging surfaces, one surface on the intermediate portion and a complimentary mating surface on the base portion.

19. The bath seat of claim 1 wherein said base portion is provided with suction cup means enabling the affixing of said base to a surface in immobile position with respect thereto.

20. A bath seat comprising a base, intermediate and top portions, said intermediate portion providing a seat for the user thereof, cooperating means between said base and intermediate portion enabling relative motion therebetween, wherein said motion that is permitted is rotational, detention means adjustable into several positions wherein said relative motion is inhibited in one position and permitted in another position, wherein said adjustable detention means comprises a plurality of abutment surfaces on one of said base and intermediate portions and a movable detent on the other of said base and intermediate portions arranged to selectively engage at least one of the abutment surfaces, and wherein the abutment surfaces comprise a plurality of discrete wall elements on one of said base or intermediate portions extending towards the other one of said base or intermediate portions, and the said portion not having the wall elements being provided with a movable detent positionable to engage at least one of said wall elements to prevent said relative motion.

21. The bath seat of claim 20 wherein the movable detent is provided with a series of teeth which are positionable to engage one or more wall elements.

22. The bath seat of claim 21 wherein said detent is provided with an operating lever.

23. The bath seat of claim 20 wherein said base portion is provided with suction cup means enabling the affixing of said base to a surface in immobile position with respect thereto.

* * * * *